United States Patent [19]

Miyagi et al.

[11] Patent Number: 4,566,359

[45] Date of Patent: Jan. 28, 1986

[54] METHOD OF STACKING FINS OF HEAT EXCHANGERS

[75] Inventors: Masahiro Miyagi; Katsuharu Uehara; Yoshio Nozawa; Takahiko Deguchi, all of Tochigi, Japan

[73] Assignee: Hitachi, Ltd., Tokyo, Japan

[21] Appl. No.: 580,237

[22] Filed: Feb. 15, 1984

[30] Foreign Application Priority Data

Feb. 16, 1983 [JP] Japan ..... 58-22777

[51] Int. Cl.[4] ..... B26D 9/00; B26D 7/00; B65H 35/06

[52] U.S. Cl. ..... 83/23; 83/95; 83/100

[58] Field of Search ..... 83/23, 95, 100

[56] References Cited

U.S. PATENT DOCUMENTS 4,195,540 4/1980 Franks ..... 83/95

4,207,667 6/1980 D'Angelo et al. ..... 83/95 X

*Primary Examiner*—Donald R. Schran

*Attorney, Agent, or Firm*—Antonelli, Terry & Wands

[57] ABSTRACT

A method of stacking fins of heat exchangers suitable for use in producing fins of a plurality of heat exchangers arranged in a group widthwise thereof, characterized by causing one group of fins after another to adhere to a suction plate and forcedly inserting tube receiving apertures formed beforehand in the fins into stacking bars to thereby stack the groups of fins.

4 Claims, 7 Drawing Figures

FIG. 4
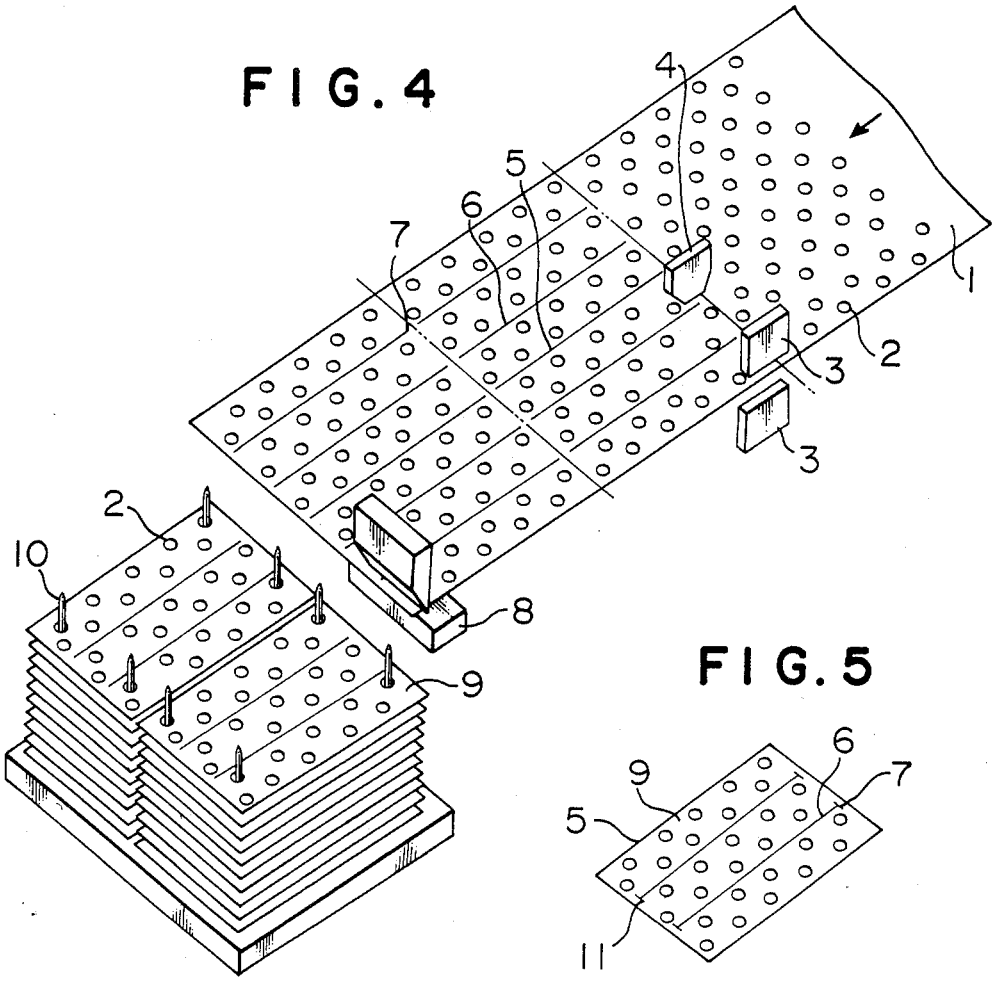
FIG. 5
FIG. 7
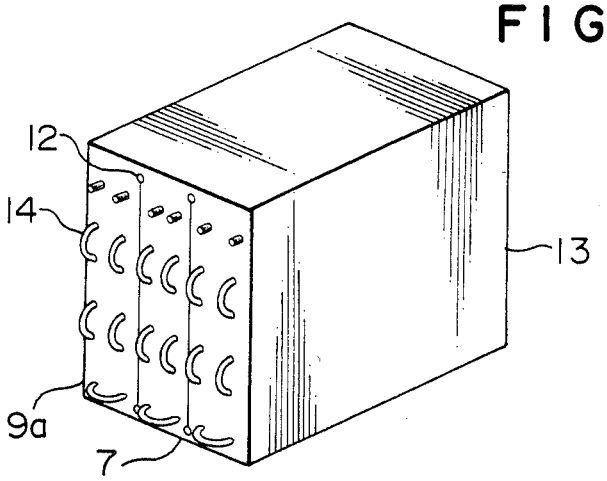
FIG. 6
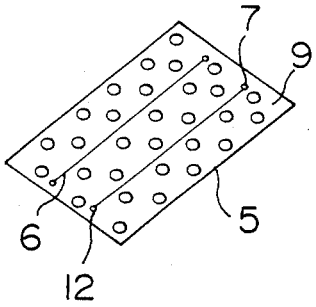

METHOD OF STACKING FINS OF HEAT EXCHANGERS

FIELD OF THE INVENTION

This invention relates to methods of stacking fins, and more particularly it deals with a method of producing and stacking fins of heat exchangers wherein stacking of the fins is effected by forcedly inserting stacking bars into apertures formed in the fins while the fins adhere to a suction plate as they are drawn thereto by suction.

BRIEF DESCRIPTION OF THE DRAWINGS

FIG. 4 is a perspective view in explanation of the steps of the method according to the invention for producing groups of fins;

FIG. 5 is a perspective view of a group of fins having a plurality of lengthwise cuts made therein to separate fins one from another widthwise of the group of fins and each having a cut made at either end at a right angle thereto;

FIG. 6 is a perspective view of a group of fins having a plurality of lengthwise cuts made therein to separate fins one from another widthwise of the group of fins and each having a small round aperture formed at either end; and FIG. 7 is a perspective view of a group of heat exchangers.

DESCRIPTION OF THE PRIOR ART

Heat exchangers hitherto used with airconditioning systems and the like comprise cross fin heat exchangers in which a plurality of elongated U-tubes are inserted in a multiplicity of plate fins and expanded to be secured in place and then short U-tubes are connected to the elongated U-tubes.

Figure 1:
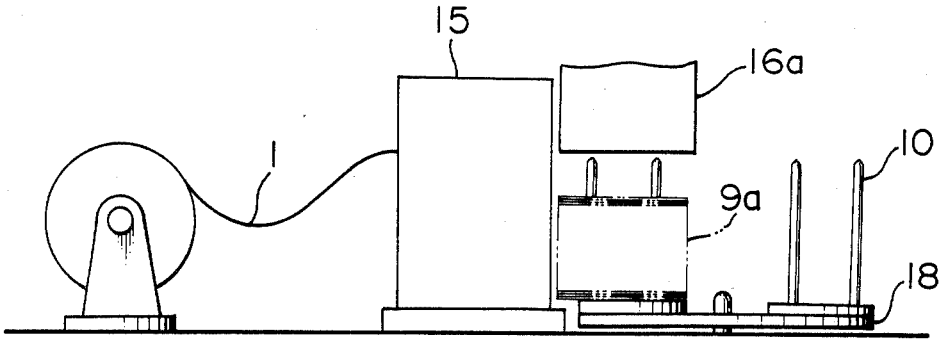
FIG. 1 PRIOR ART
FIG. 1 is a view in explanation of a fin press stacking apparatus of the prior art.
Figure 2:
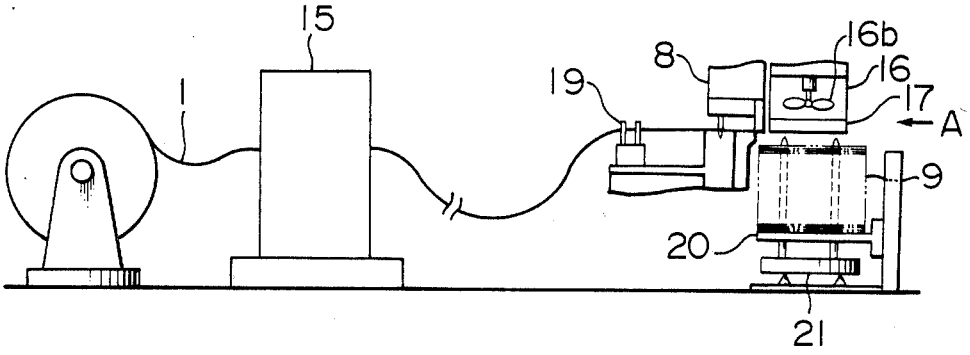
FIG. 2 is a view in explanation of the fin press stacking apparatus suitable for carrying into practice the method of producing and stacking fins of heat exchangers according to the invention.

FIG. 1 shows an apparatus used in the prior art for producing plate fins. A strip 1 of aluminum of small thickness in roll form is continuously payed out and supplied to a press 15 where it is formed by punching with tube receiving apertures and continuously cut lengthwise into a plurality of ribbons each having a width equal to that of end products. Then, the ribbons are delivered from the press 15 to a vacuum unit 16*a* which holds the ribbons by suction while they are cut to provide fins 9*a* of a desired length.

The fins 9*a* are allowed to drop by gravitational pull on to an indexing table 18 in such a manner that stacking bars 10 are inserted in the tube receiving apertures 2, until a predetermined number of fins 9*a* are stacked. Then the indexing table 18 is turned and the stack of fins 9*a* are removed and assembled with tubes. In the method of the prior art of stacking the fins, difficulties have been experienced in carrying out the fin stacking in a stable manner due to the light weight of the fins which are allowed to drop by gravity, and the yield of the press has consequently been very low. Particularly where the stacking bars have a great length, positioning of the forward ends of the bars becomes very difficult to perform, resulting in an increase in misoperations in stacking the fins. Owing to the fact the fins are stacked by utilizing the gravity, it is necessary that the diameter of the stacking bars be considerably smaller than that of the tube receiving apertures. Thus, it has hitherto been usual practice to stack the fins by using the stacking bars as a reference. As a result, insertion of tubes of a larger diameter than the stacking bars in the tube receiving apertures has been impossible without rearranging the fins. Thus, the tube inserting operation has been low in efficiency because of the need to manually hold the fins at end faces and bring them into alignment with each other.

Owing to multiplification of the needs of users requiring articles and reductions made in the number of works half done, there has in recent years been a declining tendency in the lot size of production. As a result, production facilities for heat exchangers of air-conditioning systems for space cooling have shown a drop in production efficiency because of an increase in the time required for effecting setup and adjustments in setup. Meanwhile, with regard to the automatic assembling of fins and tubes which can be performed efficiently, proposals have been made to use the following method. A strip of aluminum of small thickness is formed with a multiplicity of tube receiving apertures and continuously cut lengthwise thereof into a plurality of ribbons each having a width equal to that of end products of fins by using a punch-and-die arrangement of a press. Then, a plurality of fins in ribbon form thus provided are withdrawn from the press and have their spacing interval increased while being twisted and loosened, before they are cut widthwise thereof into individual fins of a predetermined length while forcing stacking bars slightly smaller in diameter than the tubes into the tube receiving apertures of the fins as they are stacked. Thereafter, the tubes are automatically inserted into the tube receiving apertures of the fins.

In the method described hereinabove, the fins are supported at opposite sides and guided by guide plates. Because of this, it is possible to positively effect positioning of the fins even if the fins in ribbon form are fed in a condition in which they are bent due to a distortion produced therein in the preceding operation step, resulting in fins being positively inserted in the stacking bars. As described hereinabove, the stacking bars have a diameter slightly smaller than that of the tube receiving apertures, so that displacing of the tube receiving apertures of the stack of fins is avoided and insertion of the tubes in the tube receiving apertures in the next following step is facilitated. This is conducive to automation of tube insertion operations. When the method of forcedly inserting the tube receiving apertures of the fins into the stacking bars of a fin stacking unit while guiding the fins lengthwise by using the guide plates as aforesaid is used, it is possible to positively stack the fins of small thickness, and the tubes can be automatically inserted in the tube receiving apertures of the fins without any difficulty. Thus, the method enables automatic operation of fin stacking and tube insertion to be performed with a high degree of reliability, thereby reducing operation steps and increasing the yield of the production facilities. Some disadvantages are, however, associated with this method. One of them is that, since the fins are guided at the opposite sides by the guide plates, the apparatus is only good for handling one type of fins so long as the width is concerned. If the apparatus is required to handle fins of different widths, then the positions in which the fin guide plates and stacking bars of a fin stacking unit are located and the position in which a tube inserting unit is located should be altered.

SUMMARY OF THE INVENTION

This invention has been developed for the purpose of obviating the aforesaid disadvantage of the prior art. Accordingly, the invention has as its object the provision of a method of stacking fins of heat exchangers suitable for use in producing fins of a group of heat exchangers including a plurality of heat exchangers arranged width wise, whereby the fins can be positively stacked one after another by automatically inserting tube receiving apertures of the fins into stacking bars.

The outstanding characteristic of the invention that enables the aforesaid object to be accomplished is that groups of fins are positively stacked with a high degree of precision as the groups of fins drawn by suction and adhering to a suction plate are forcedly inserted in the stacking bars.

DESCRIPTION OF THE PREFERRED EMBODIMENT

A preferred embodiment of the invention will now be described by referring to FIGS. 2–7 in which the strip 1 of aluminum of 0.1–0.15 mm thick is formed with a multiplicity of tube receiving apertures (usually formed with fin collars) 2, and then it is cut lengthwise thereof into a plurality of ribbons each having a predetermined width corresponding to the width of fins produced as end products, by a cutting unit comprising cutters 3 and 4 shown in FIG. 4. The ribbons thus produced are fed at a predetermined rate by a feeding unit 19 to a fin stacking station. An arrow shown in FIG. 4 indicates a direction in which the ribbons are fed. The cutters 3 have the function of cutting the strip 1 along a line 5 which is continuous from a leading end of the strip 1 to a trailing end thereof, and the cutters 4 have the function of cutting a plurality of lines 6 which are intermittent. The cutters 3 may be constructed such that the length of cutting edges thereof engaging each other is slightly greater than the distance covered by the movement of the ribbons which are fed at a predetermined rate by the feeding unit 19 as described hereinabove. The cutters 4 may be constructed such that an upper cutting edge lacks front and rear corners so that, when first and last strokes of cut are made lengthwise of the strip 1 by the cutters 4, the cutting edges engaging each other have a smaller depth than when an intermediate stroke of cut is made. This enables the intermittent lines 6 of cut to be formed while leaving opposite ends of each line 6 uncut, to allow fins of a predetermined length to be obtained readily later on. The depth of engagement of the cutting edges of the cutters 4 can be controlled as by actuating cylinders of the cutting unit. As aforesaid, the intermittent lines 6 each have uncut portions 7 at the opposite ends. However, this is not restrictive and one uncut portion 7 may only be located at one end of each intermittent line 6. The embodiment shown and described herein is a method of simultaneously producing three double rows heat exchanges which are arranged widthwise. However, by altering the positions in which the cutters 3 and 4 are located, it is possible to simultaneously produce six single row heat exchangers or two triple row heat exchangers as desired. A group of fins may be arranged in any number of rows as desired. In the case of a group of fins having twelve (12) rows which is twice the number of rows of the embodiment shown and described herein, it is possible to produce groups of fins with a flexibility such that four types of heat exchangers in which fins are arranged in 1–4 rows may be selectively produced, showing that the method according to the invention is versatile.

After the continuous line 5 of cut and intermittent lines 6 of cut are made in the strip 1 as described hereinabove, to produce a plurality of ribbons from which groups of fins can be obtained later on, the ribbons are withdrawn from the press and have their spacing interval increased while being twisted and loosened, before being fed by the feeding unit 19 at a predetermined rate to the fin stacking station. Unlike the strip of aluminum of the prior art which is cut into individual fins in ribbon form, the strip 1 of aluminum is cut according to the invention into groups of fins 9 in ribbon form which are free from bends. This makes it possible for the tube receiving apertures 2 to be readily inserted into the stacking bars 10 to stack a multiplicity of groups of fins 9 without any trouble while cutting the ribbons widthwise thereof by cutters 8 to produce the groups of fins 9 of a desired length. In the method according to the invention, the groups of fins may be stacked as follows. The ribbons are fed by the feeding unit 19 at a predetermined rate while a portion of the ribbons extending beyond the cutters 8 is drawn by a propeller fan **16*b* built in a vacuum unit 16 and made to adhere to a suction plate 17. The portion of the ribbons adhering to the suction plate 17 is cut widthwise thereof when its length has reached a predetermined value, to thereby provide a group of fins 9. Then, the suction plate 17 is lowered while the group of fins 9 remains adhering thereto so that the fin stacking bars 10 slightly smaller in diameter than the tube receiving apertures 2 can be forcedly inserted in the fin stacking bars 10. When the tube receiving apertures 2 have been inserted into the fin stacking bars 10, the suction plate 17 is rendered inoperative to release the group of fins 9 from engagement therewith. The suction plate 17 may function to guide the group of fins 9 widthwise, or may be formed of grooves 17*a* of a width equal to that of curls of the fin collars of the apertures 2 to guide the curls for each row, to enable stacking of the groups of fins 9 to be achieved with improved results. Thus the ribbons withdrawn from the press pose no problem even if the tube receiving apertures 2 are forcedly inserted in the stacking bars 10 to stack the group of fins 9 on the indexing table 18** at the stacking station.

Figure 3:
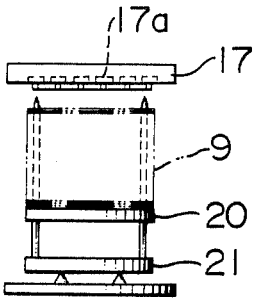
FIG. 3 is a view as seen in the direction of an arrow A in FIG. 2.

Each group of fins 9 may be cut to form a short line 11 of cut at either end of each line 6 of cut at a right angle thereto as shown in FIG. 5, or a small round hole 12 may be formed at either end of each line 6 of cut of each group of fins 9 as shown in FIG. 6. This makes it possible to cut the uncut portions 7 without any trouble to separate heat exchangers from one another when a group of heat exchangers 13 shown in FIG. 7 is obtained, because the heat exchangers can be severed from one another readily even if positions in which the uncut portions 7 are cut are slightly displaced from the respective lines 6 of cut. When it is desired to increase the height of the stack of the groups of fins 9, it would be necessary to increase the length of the stacking bars 10. If the length of the stacking bars 10 were increased, the forward ends of the stacking bars 10 might be brought out of index with the tube receiving apertures 2 when the stacking bars 10 were merely supported on a truck 21 as shown in FIG. 3. To keep the forward ends of the stacking bars 10 substantially indexed with the tube receiving apertures 2, a support plate 20 may be used to support the groups of fins 9 midway between opposite ends of the stacking bars 10. The support plate 20 may be moved downwardly on to the truck 21 after a suitable number of groups of fins 9 have been stacked.

If the aforesaid system of positively stacking the groups of fins 9 one after another by using the stacking bars is used when fins of a plurality of heat exchangers arranged widthwise in a group are produced, it is possible to cope with any number of heat exchangers to be produced as a group. This system of stacking the groups of fins is very flexible and greatly increases the yield of a press.

The system of stacking the groups of fins 9 used in the method according to the invention is so flexible that a group of fins of any number of rows can be produced without being limited by the number of rows of the heat exchangers forming a group.

Also, the stacking bars that the tube receiving apertures of the fins are inserted into are slightly smaller in diameter than the tube receiving apertures. This enables a stack of the groups of fins to be obtained positively and allows insertion of tubes in the fins to be automatically performed because there is no displacement of the tube receiving apertures.

What is claimed is:

1. A method of producing and stacking fins of heat exchangers comprising the steps of:

forming in a strip of metal a multiplicity of apertures for inserting tubes therein;

cutting said strip of metal lengthwise to form a continuous line of cut extending from a leading edge of the strip to a trailing edge thereof, cutting a plurality of intermittent lines of cut disposed parallel to one another lengthwise of the strip while leaving uncut portions at opposite ends of the intermittent lines, said continuous line and intermittent lines being spaced apart widthwise of the strip by an interval corresponding to the width of fins to be produced as end products;

drawing said strip by suction to cause same to adhere to a suction plate;

cutting across said strip at points spaced apart lengthwise of said strip at the uncut portions of the intermittent lines of cut by a distance corresponding to the length of the fins to provide a multiplicity of groups of fins; and forcing said apertures of the fins of each said group of fins onto stacking bars to stack one group of fins after another to provide a stack of the groups of fins.

2. A method of producing and stacking fins of heat exchangers as claimed in claim 1 further comprising the step of cutting said uncut portions of the strip to form at either end of each said intermittent line of cut a short line of cut disposed at a right angle thereto.

3. A method of producing and stacking fins of heat exchangers as claimed in claim 1, further comprising the step of cutting said uncut portions of the strip to form at either end of each said intermittent line of cut a small hole.

4. A method of producing and stacking fins of heat exchangers as claimed in claim 1, wherein the step of forcing said aperatures of fins of each said group of fins onto stacking bars includes lowering of the suction plate while the fins of each said group are adhered thereto, and thereafter releasing the fins of each said group from the suction plate, and raising the suction plate for the next operation.

* * * * *